US011571606B1

(12) United States Patent
Wang et al.

(10) Patent No.: US 11,571,606 B1
(45) Date of Patent: Feb. 7, 2023

(54) RESISTANCE TRAINING DEVICE WITH FEEDBACK LIGHTS

(71) Applicants: Christopher Wang, Katy, TX (US); Aaryan M Memon, Katy, TX (US); Saqib M Memon, Katy, TX (US)

(72) Inventors: Christopher Wang, Katy, TX (US); Aaryan M Memon, Katy, TX (US); Saqib M Memon, Katy, TX (US)

( * ) Notice: Subject to any disclaimer, the term of this patent is extended or adjusted under 35 U.S.C. 154(b) by 0 days.

(21) Appl. No.: 17/404,965

(22) Filed: Aug. 17, 2021

(51) Int. Cl.
*A63B 24/00* (2006.01)
*A63B 21/00* (2006.01)
*A63B 22/20* (2006.01)

(52) U.S. Cl.
CPC .... *A63B 24/0006* (2013.01); *A63B 21/00065* (2013.01); *A63B 22/20* (2013.01); *A63B 2220/40* (2013.01)

(58) Field of Classification Search
CPC ..... A63B 21/00065; A63B 21/0004; A63B 21/0605; A63B 21/4027; A63B 21/4041; A63B 21/4043; A63B 22/20; A63B 22/0002; A63B 22/18; A63B 22/201; A63B 22/203; A63B 24/0006; A63B 2220/40
See application file for complete search history.

(56) References Cited

U.S. PATENT DOCUMENTS

| | | | | |
|---|---|---|---|---|
| 3,007,699 | A | 11/1961 | Taylor | |
| 6,942,585 | B1 | 9/2005 | Krause | |
| 7,727,089 | B2 | 6/2010 | Gilman | |
| 7,927,052 | B1 | 4/2011 | Varden | |
| 8,469,861 | B1 | 6/2013 | McFee | |
| 8,986,172 | B2 * | 3/2015 | Poole | A63B 23/03541 473/441 |
| 9,643,040 | B1 * | 5/2017 | Guerrero Diaz | A63B 23/047 |
| 9,759,738 | B2 | 9/2017 | Oleson et al. | |
| 9,834,242 | B2 | 12/2017 | Wang | |
| 10,799,750 | B2 | 10/2020 | Baumler et al. | |
| 10,923,225 | B2 | 2/2021 | Riley et al. | |
| 11,179,591 | B1 * | 11/2021 | Bazargan | A63B 21/0051 |
| 2006/0035734 | A1 | 2/2006 | Borunda | |
| 2011/0224050 | A1 * | 9/2011 | Larish | A63B 23/1209 482/93 |

* cited by examiner

*Primary Examiner* — Megan Anderson

(57) ABSTRACT

Embodiments of the present invention comprise a 4-wheeled resistance training device in the form of a box, wherein a user may add weights to the inside or to the top of the box to increase the resistance provided to the user. The wheels may be connected to the box by one or more threaded axles, each threaded axle existing as two or more parts. Rotation of the threaded axles may power a generator, which may power a light system comprising one or more lights. The light system may provide visual feedback to a user by changing the color and/or intensity of the one or more lights depending on multiple factors. Further embodiments of the invention may comprise a battery for storing energy generated by the generator. Embodiments of the invention may also comprise the ability to store data about a user's workout.

16 Claims, 3 Drawing Sheets

RESISTANCE TRAINING DEVICE WITH FEEDBACK LIGHTS

BACKGROUND OF INVENTION

The present invention relates to the field of resistance training devices. Many devices exist in the field of resistance training devices that provide weighted devices that a user may push or pull in order to participate in resistance-based exercises. Basic forms of said devices exist as training sleds, such as those described in U.S. Pat. No. 7,727,089. These training sleds generally comprise metal rods or bars formed into a sled shape that may be pushed or pulled by a user. Weights may be added to these sleds to increase the resistance provided to the user.

These basic training sleds comprise multiple shortcomings. One of said shortcomings is that basic training sleds are difficult to move, even when it is not desired to use the training sleds for exercise. For example, if a training sled is being used by an athletic team, and the team wishes to move the training sled to make room for a different piece of exercise equipment, members of the team must push or pull the training sled in order to move it and thus experience the resistance provided by the training sled. This may not be desired when the training sled is simply being moved to make room for different exercise equipment.

Another shortcoming of training sleds is that the generally provide a relatively large amount of resistance, even when not loaded with extra weight. While this may be desirable for fully-grown athletes, it is not desirable for younger athletes than are unable to move objects that provide relatively large amounts of resistance.

Some training devices in the art aim to overcome these shortcomings of training sleds by providing training devices with wheels. Since wheels allow an object to experience less friction between said object and the ground, these wheeled training devices present options of exercise equipment that are easy to move when not being used for resistance training. Many of these wheeled training devices comprise mechanism that allow users to add weights to the devices or to increase the resistance by means of brakes or other features. An example of one of said wheeled training devices is described in U.S. Ser. No. 10/799,770.

The wheeled training devices such as that described in U.S. Ser. No. 10/799,750 also comprise shortcomings in that they are essentially just a weighted object on wheels. Thus, it is difficult for a user to gather data on their workout while using these basic wheeled devices. Many users wish to receive information about their workout in real time, such as their speed, heartrate, approximate calories burned, etc. Therefore, an improvement upon basic wheeled resistance training devices would be some sort of feedback mechanism that displays information to a user.

Some exercise devices in the art do comprise some sort of feedback mechanism, such as treadmills that display a user's speed and rowing machines that display a user's strokes per minute. However, not all of these exercise devices are resistance training devices that may be pushed or pulled by a user. One device that is a resistance training device that provides a display for a user is described in U.S. Pat. No. 8,469,861. U.S. Pat. No. 8,469,861 describes a 3-wheeled resistance training device, wherein pushing or pulling the device turns a first wheel which powers an electrical system. Said electrical system may be used to display information on the user's workout such as speed, etc. Resistance may be added to this device by use of an electric brake system powered by the turning of the first wheel.

While the resistance training device described in U.S. Pat. No. 8,469,861 overcomes the shortcomings in the art described thus far, it presents its own shortcomings. One of said shortcomings is the electric brake system. The electric brake system described in U.S. Pat. No. 8,469,861 is a much more complicated manner of adding resistance than simply adding weights to a resistance training device. Because of this, it is expected that this electric brake system will require regular maintenance, whereas a simpler system of adding resistance to a training device would not require as much maintenance. Furthermore, the fact that the resistance training device described in U.S. Pat. No. 8,469,861 has three wheels, and the fact that the display may comprise a screen with text and numbers present the shortcoming of being less user-friendly by children. Children may experience difficulty in keeping a 3-wheeled device upright while pushing or pulling said device. Furthermore, children may be confused by complicated displays with lots of words and numbers.

Due to the shortcomings of the prior art described thus far, as well as other shortcomings that will become obvious to those skilled in the art after reading the ensuing description, there exists a need in the art for a non-complex, wheeled resistance training device that provides simple feedback to users.

SUMMARY OF INVENTION

Embodiments of the present invention comprise a 4-wheeled resistance training device in the form of a box, wherein a user may add weights to the inside or to the top of the box to increase the resistance provided to the user. The wheels may be connected to the box by one or more threaded axles, each threaded axle existing as two or more parts. Rotation of the threaded axles may power a generator, which may power a light system comprising one or more lights.

The light system may provide visual feedback to a user by changing the color and/or intensity of the one or more lights depending on multiple factors. Said factors may include but are not limited to the speed at which a user moves the device, the direction in which the user moves the device, the acceleration the device experiences when acted upon by a user, and the weight added to the device.

Further embodiments of the invention may comprise a battery for storing energy generated by the generator but not immediately used by the light system. The battery may then be used to power the light system when the device is not in motion. Alternatively, the battery may be used to power other devices. Embodiments of the invention may also comprise the ability to store data about a user's workout, such as but not limited to the duration of the workout, speeds at which the user moved the device, and weight that was added to the device.

DETAILED DESCRIPTION

The description provided herein describes example embodiments of the present invention and is not intended to limit the invention to any particular embodiment, feature, size, shape, function, or any other property. The figures provided herein are for purposes of example and are not intended to limit the invention to any particular embodiment, feature, size, shape, function, or any other property. The claimed invention is best understood by the appended claims.

It shall be noted that the figures provided herein are not drawn to scale and thus shall not be interpreted as such. Furthermore, the figures provided herein may omit certain features of the invention. Said features may be described herein as features that only exist in some embodiments of the invention. Furthermore, the omitted features may be standard electrical and/or mechanical components that are necessary to allow the invention to function. Said components will become obvious to those skilled in the related arts upon reading the ensuing description.

Figure 1:
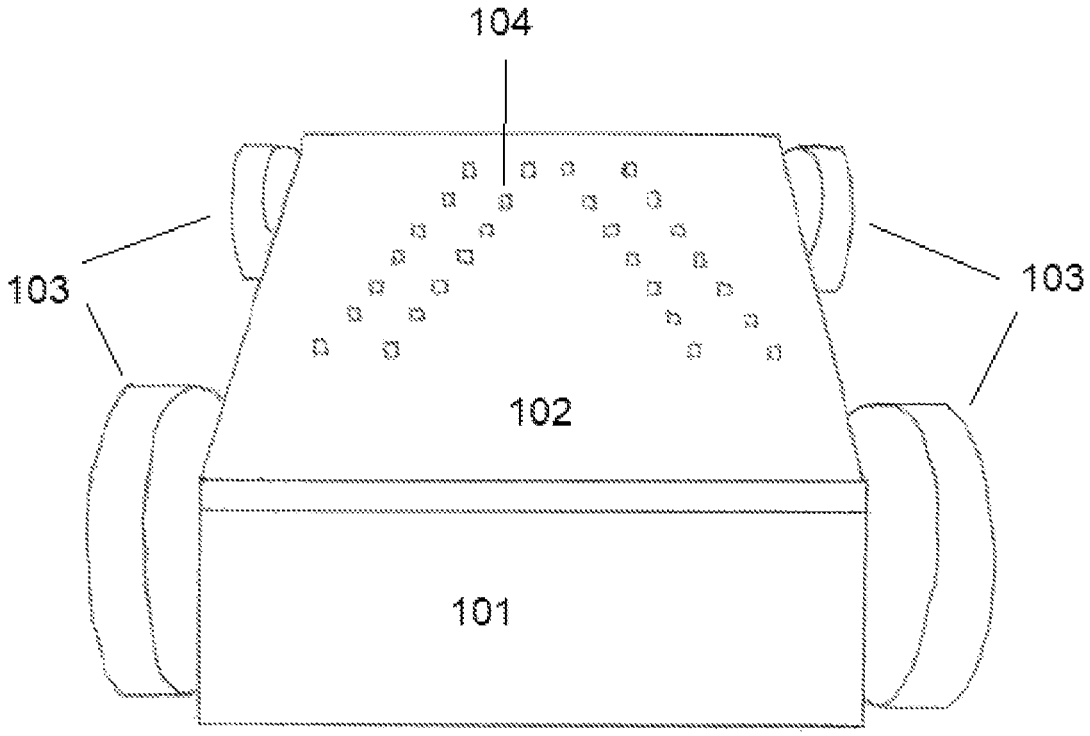
FIG. 1 illustrates a resistance training device with a closed lid.

Embodiments of the present invention comprise a 4-wheeled resistance training device. In some embodiments, the training device may be in the form of a box. The box may be of a rectangular shape or any other shape. FIG. 1 illustrates the present invention as it exists in some embodiments. FIG. 1 illustrates the main body 101, the lid 102, the wheels 103, and the feedback light system 104 of the resistance training device. In the embodiments of the invention illustrated in FIG. 1, the main body comprises 4 walls and a floor arranged to form a rectangular box with an opening. Components of the invention may be housed within the main body. These components are described further herein. The lid may be affixed to the main body by use of hinges (not shown) or by any other method of rotatably fixing one end of an object to one end of another object. The hinges allow the lid to rotate relative to the main body and thus allow the lid to "open" or "close". The lid may be considered "closed" when the lid completely covers the opening of the main body as illustrated in FIG. 1. The lid may be considered "open" when it is rotated relative to the main body to expose at least a portion of the opening of the main body.

The lid may serve as a surface on which a user may place weights to add additional resistance to the resistance training device. In some embodiments, the lid may comprise features specific for holding additional weights (not shown). An example of one of said features is a post that extends vertically from the top surface of the lid around which circular weightlifting plates may be placed. Another example of one said features is a plurality of walls extending vertically from the top surface of the lid, said plurality of walls forming a box on the top surface of the lid inside of which additional weights may be placed.

The lid may further comprise the feedback light system. The feedback light system may comprise a plurality of individual lights. Said lights may be LED lights. In some embodiments, the feedback light system may comprise individual lights of uniform size, shape, and color. In other embodiments, the feedback light system may comprise individual lights of different sizes, shapes, and colors. In some embodiments, the feedback light system may comprise individual lights that are capable of changing color and or brightness independently of one another or in unison with one another. The feedback light system may be powered by components of the invention described further herein.

The feedback light system may serve to provide simple feedback to a user of the resistance training device. For example, the individual lights of the feedback light system may light up when the device is put in motion. The individual lights may become brighter as the resistance training device is moved at a greater speed. The individual lights may change color, blink, pulse, flicker, or perform any combination of said functions as a response to various motion properties experienced by the resistance training device. Said motion properties may be but are not limited to acceleration, deceleration, change in direction, addition of weight, and removal of weight.

It shall be noted that the arrangement of individual lights within the feedback light system illustrated in FIG. 1 is one example of the arrangement of individual lights in the feedback light system of the invention. Other embodiments of the invention may comprise individual lights arranged in different arrangements. In some embodiments of the invention, the feedback light system may comprise a left side and a right side, which correspond with a left side and a right side of the main body of the resistance training device. As the resistance training device is moved to the left, the individual lights on the left side of the feedback light system may respond by lighting up, changing color, blinking, pulsing, flickering, or performing any other action to display greater prominence. Similarly, as the resistance training device is moved to the right, the individual lights on the right side of the feedback light system may respond by lighting up, changing color, blinking, pulsing, flickering, or performing any other action to display greater prominence. As the resistance training device is moved to the right, the individual lights on the left side of the feedback light system may react by turning off, changing color, or performing any other reaction in order to display less prominence. Similarly, ss the resistance training device is moved to the left, the individual lights on the right side of the feedback light system may react by turning off, changing color, or performing any other reaction in order to display less prominence.

While different embodiments of the invention may comprise a different number of wheels, preferred embodiments of the invention comprise 4 wheels. The wheels may be attached to the main body by use of axles (not shown in FIG. 1). The main body may comprise bearings with which to hold the axles while allowing the axles to rotate freely relative to the main body. The axles may be attached to the wheels by common means known in the related arts. The 4-wheeled design of the resistance training device allows the device to remain stable during use, unlike 3-wheeled resistance training devices in the art that may easily tip over during use.

Figure 2:
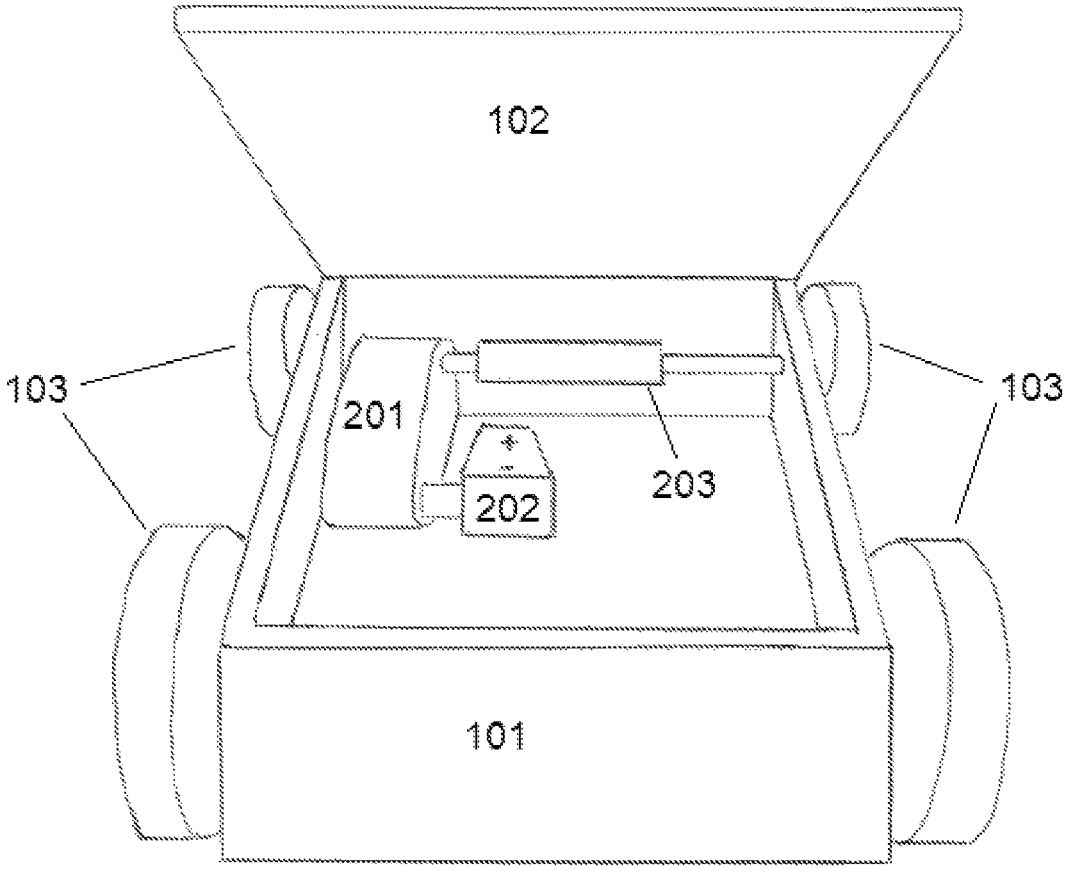
FIG. 2 illustrates a resistance training device with an open lid.

FIG. 2 illustrates the embodiments of the invention illustrated in FIG. 1, though the lid is illustrated as open in FIG. 2. In addition to the main body 101, lid 102, and wheels 103, FIG. 2 illustrates the generator 201, battery 202, and a two-part threaded axle 203. By pushing the resistance training device, the user turns the wheels, thus turning the axles that connect the wheels to the main body. One or both of said axles may be connected to the generator in order to convert mechanical energy into electrical energy. This electrical energy may be used to power the feedback light system, as well as the other electrical components of the resistance training device. The electrical energy outputted by the generator may also by stored in the battery. The battery may be used to supplement the electrical energy outputted by the generator to power the feedback light system and other electrical components of the resistance training device.

For example, a user may use the resistance training device to perform an intense workout at high speeds, thus generating more energy than needed to power the feedback light system. The extra energy not used to power the feedback light system may be stored in the battery. In the example, the user uses the resistance training device to perform a less intense workout at lower speeds the next day, and thus does not generate enough energy to power the feedback light system. Thus, the energy stored in the battery is used to supplement the energy generated by the generator so that the user is still able to view feedback from the feedback light system during the user's less intense workout.

Other uses of the battery may include storing energy generated by the generator for use in another device. For example, in some embodiments the battery may be removable from the resistance training device and placed in another device such as a portable cell phone charger or a flashlight. Thus, the resistance training device may be used to generate energy for other device as an added benefit of serving as an exercise device.

In addition to using energy generated by the generator and energy stored within the battery, the feedback light system and other electrical components of the resistance training device may be powered by solar panels (not shown) located on the lid of the resistance training device. The solar panels may gather solar energy, convert the solar energy into electrical energy, and either use the electrical energy to directly power the feedback light system and other electrical components, store the electrical energy in the battery, or both.

The resistance training device may comprise a voltage regulator (not shown). When a user is pushing or pulling the resistance training device, it is unlikely that the axles will experience uniform rotational motion. This is to say that a user is likely to accelerate and decelerate slightly even though they appear to be moving at a constant speed. These slight accelerations and decelerations by the user will result in slight accelerations and decelerations of the rotational speeds of the axles, which will result in non-uniform voltage generation by the generator. The voltage regulator serves to "smooth" the voltage that is inputted to the feedback light system so that the feedback light system responds to the user's motions with uniform feedback.

For example, the various electrical components of the resistance training device may be programmed so that any acceleration or deceleration with an absolute value of 0.05 $m/s^2$ or less is considered negligible, and thus the individual lights of the feedback light system will react to accelerations and declarations within this range as if the individual lights were reacting to a constant speed. In this example, the individual lights display non-blinking white light when the resistance training device experiences a constant speed greater than 0 m/s. Also in this example, the individual lights blink green when the resistance training device is accelerating and blink red when the resistance training device is decelerating. If a user in this example is pushing the resistance training device at an acceleration of 0.03 $m/s^2$ the lights will display non-blinking white light. If the user then begins to speed up and adjusts their acceleration to 0.06 $m/s^2$, the lights will begin to blink green.

In another example, the individual lights of the feedback light system increase in brightness during acceleration and decrease in brightness during deceleration. Assuming the same programmed acceleration and speed values of the previous example, the lights will stay at a constant brightness when the user pushes the resistance training devices at an acceleration of 0.03 $m/s^2$, and will increase in brightness if the user increases their acceleration to 0.06 $m/s^2$.

The specific reactions of the feedback light system, including the specific colors, described in the previous examples are for example only. These specific reactions may only exist in some embodiments of the invention, or may not exist in any embodiments of the invention. Furthermore, the specific values for acceleration and speed mentioned in the previous examples may not be used in all or any of the embodiments of the invention. The previous examples are intended to describe the concept of smoothing voltage in order to provide uniform feedback when desired, and are not intended to limit the invention to any particular feedback light system reactions or programmed acceleration and speed values.

Some embodiments of the invention may comprise data collection capabilities. In these embodiments, the various sensors of the invention mentioned herein such as accelerometers and speedometers may send information about a user's workout to another device in the form of non-transitory, computer-readable media. The other device may be a smartphone, tablet, general-purpose computer, special-purpose computer, or any other device capable of receiving and processing non-transitory, computer-readable media. Said information may be sent via a wireless connection between the resistance training device and the other device. Said wireless connection may be a Bluetooth® connection, Wi-Fi connection, or any other wireless connection known in the related arts. The various components necessary to accomplish the data collection and wireless connection may be powered directly by the generator or solar panels of the resistance training device. Said components may also be powered by the battery of the resistance training device.

The data collection capabilities of some embodiments of the invention may be used to analyze the performance of a user. For example, a user of the resistance training device may be a child athlete that is only interested in gaining information about their workout through the simple feedback light system. However, the child athlete's coach may wish to gather and store more informative data such as the exact speeds and accelerations of the user's workout, as well as the durations of these speeds and accelerations. This may be accomplished by use of the data collection capabilities of the invention. The various components used for data collection may be controlled by the other device, and thus the person such as the child athlete's coach who wishes to gather the data may control when data is collected and what type of data is collected.

Programming of the various electrical components of the resistance training device has been mentioned herein. It is also understood by those skilled in the related arts that programming of some of the electrical components of the invention is necessary to achieve certain capabilities such as data collection and having the feedback light system adjusting to various motion properties. Because there is a need to program some of the various electrical components of the resistance training device, the resistance training device may further comprise additional electrical components such as motherboards, microchips, processors, and other such components required to translate non-transitory, computer-readable media into electrical outputs. These additional components may be powered directly by the generator or solar panels of the resistance training device, as well as by the battery of the resistance training device. The invention may utilize any platform or programming language to program the electrical components of the resistance training device by inputting non-transitory, computer-readable media and outputting electrical signals.

Not shown in FIG. 2 are some of the various electrical components necessary for the invention to function. For example, the wiring between the generator and the feedback light system is not shown in FIG. 2. Other such components are the various sensors such as speedometers, accelerometers, compasses, etc. required to detect changes in speed and direction and send said changes to the feedback light system. Components such as these are not illustrated in order to clearly illustrate the novel components of the invention described in detail herein. It shall be understood by those skilled in the related arts that while certain common electrical and mechanical components are not illustrated or described herein, said common electrical and mechanical components are still present in embodiments of the invention.

Figure 3A:
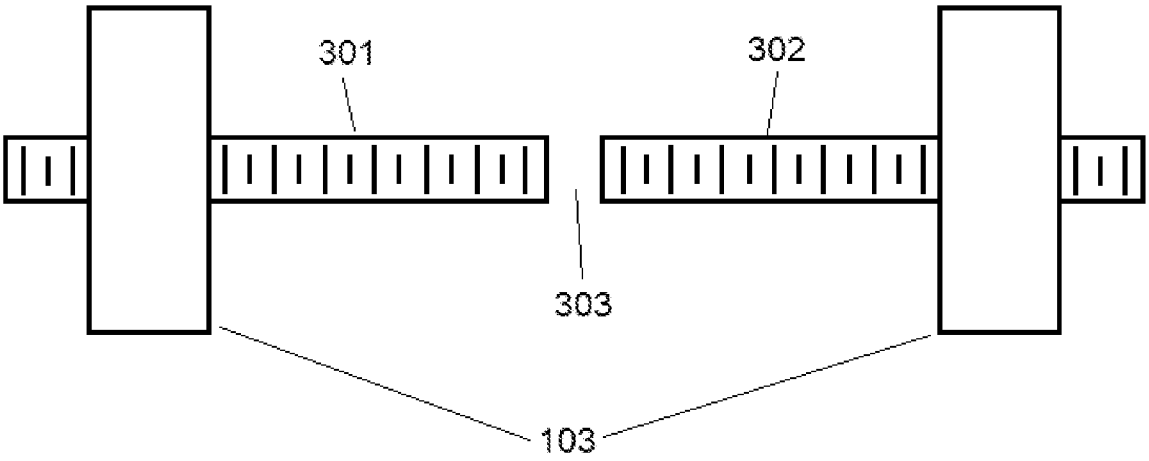
FIG. 3A illustrates a two-part threaded axle.
Figure 3B:
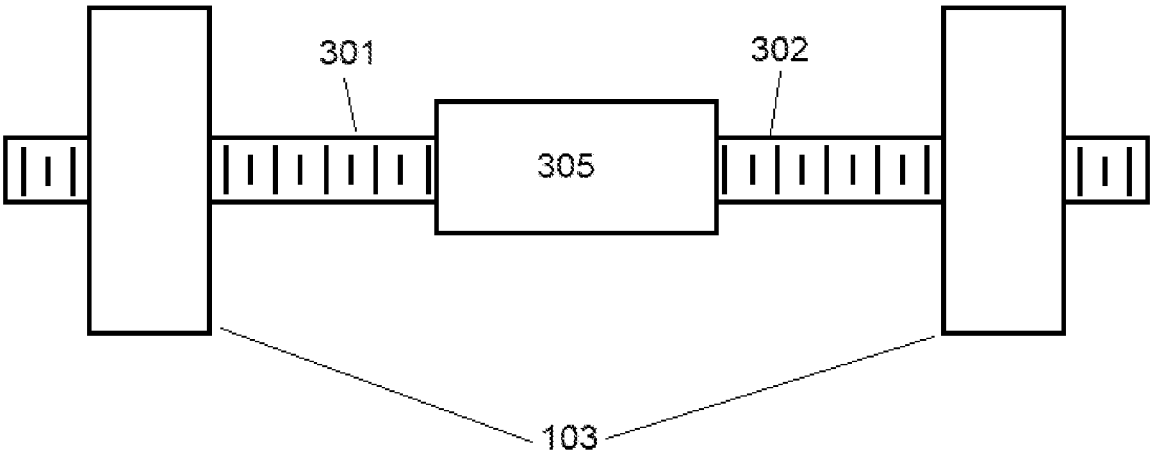
FIG. 3B illustrates a two-part threaded axle with an axle cover.

Turning now to FIGS. 3A and 3B, an axle that exists in some embodiments of the invention is illustrated. The axle illustrated in FIGS. 3A and 3B is a two-part threaded axle. This type of axle is referred to herein as a "two-part" threaded axle, though the axle may comprise more than two parts. It is referred to as a "two-part" threaded axle since only two of the axle portions are threaded.

The axle may be threaded in order to provide greater resistance to the user when pushing or pulling the resistance training device. As described further herein, the threaded portions of the two-part threaded axle may thread into the wheels of the resistance training device, and thus make it more difficult for a user to rotate the wheels of the resistance training device by pushing or pulling on the main body of the resistance training device.

FIG. 3A illustrates a first portion 301 and a second portion 302 of a two-part threaded axle, separated by a break 303. The break may comprise an empty space between the first portion and second portion. In some embodiments of the invention, the first portion and second portion may each be attached to one of the wheels 103 by means of threads. The first and second portions may comprise external threads that mate with corresponding internal threads within the wheels. Alternatively, the first and second portions may comprise internal threads that mate with corresponding external threads within the wheels.

The purpose of the break is to ensure that the wheels remain in fixed locations along the lengths of the first and second portions. Without the break, the engagement of the threads of the wheels and the threads of the first and second portions may cause the wheels to travel along the length of the threads. This is undesirable as it would change the locations of the wheels relative to the main body of the resistance training device, which could cause the resistance training device to become unstable or inoperable. The break allows the first and second portions to rotate independently of one another, and thus the engagement of the threads of the first and second portions with the wheels would not cause movement of the wheels along the lengths of the first and second portions of the two-part threaded axle.

The presence of the break may allow the ends of the first and second portions to experience slight motions independent of one another. This may create "wobble" when a user moves the resistance training device and may cause the resistance training device to feel unstable. The presence of wobble may make it difficult for a user to move the resistance training device in a straight line. Therefore, in some embodiments of the invention, the ends of the first and second portions nearest to the break may be encased within an axle cover 305, as illustrated in FIG. 3B. The axle cover does not comprise threads and thus allows the first and second portions to rotate freely relative to the axle cover. The inner diameter of the axle cover may be dimensioned appropriately to prevent the ends of the first and second portions encased within the axle cover from moving relative to one another except for in an axial rotational direction, and thus prevents wobble in the resistance training device.

The ends of the first and second portions nearest to the break may further be considered adjacent to the break, and may be referred to as the "break ends" of the first and second portions. The ends of the first and second portions opposite of the break ends may be referred to as the "far ends."

The first and second portions of the two-part threaded axle may engage with the main body of the resistance training device through holes in the main body of the resistance training device. In order to prevent movement of the wheels along the lengths of the first and second portions of the two-part threaded axle, the holes in the main body of the resistance training device may comprise bearings that accept the first and second portions. Thus, the first and second portions of the two-part threaded axle are not threaded into the main body of the resistance training device.

The various components of the invention described herein may be made of any materials and by any manufacturing processes. In some embodiments of the invention, the main body and lid are made of wood. In some embodiments of the invention, the first and second portions of the two-part threaded axle are made of metal, and the axle cover is made of PVC.

What is claimed is:

1. A resistance training device comprising:
- four wheels;
- a main body;
- a lid;
- a feedback light system comprising a plurality of individual lights;
- at least one two-part threaded axle; and
- a generator,
- wherein the at least one two-part threaded axle engages with two of the four wheels and with the generator such that rotation of the two wheels causes rotation of the at least one two-part threaded axle which powers the generator, and wherein the generator is electrically coupled to the feedback light system such that when the rotation of the at least one two-part threaded axle powers the generator, the generator generates electrical energy that powers the feedback light system when the resistance training device is in use.

2. The resistance training device of claim 1, wherein the plurality of individual lights exhibit at least one of a plurality of reactions when the resistance training device accelerates or decelerates.

3. The resistance training device of claim 2, wherein the feedback light system comprises a left side and a right side, and wherein both the left side and the right side comprise individual lights of the plurality of individual lights.

4. The resistance training device of claim 3, wherein the individual lights of the left side of the feedback light system exhibit at least one of a plurality of reactions when the resistance training device is moved to the left, and wherein the individual lights of the right side of the feedback light system exhibit at least one of a plurality of reactions when the resistance training device is moved to the right.

5. The resistance training device of claim 4, wherein the plurality of reactions comprises:
- changing in brightness;
- changing in color;
- blinking;
- pulsing; and
- flickering.

6. The resistance training device of claim 5, further comprising a voltage regulator, wherein the voltage regulator smooths the voltage of the electrical energy used to power the feedback light system.

7. The resistance training device of claim 5, further comprising a battery, wherein the electrical energy generated by the generator is configured to be stored in the battery in addition to powering the feedback light system.

8. The resistance training device of claim 5, wherein the electrical energy stored within the battery is configured to also be used to power the feedback light system.

9. The resistance training device of claim 5, wherein the resistance training device is configured to gather data on the motion of the resistance training device in the form of non-transitory, computer-readable media, and wherein the resistance training device is configured to send said data to another device by means of a wireless connection.

10. The resistance training device of claim 2, wherein the plurality of reactions comprises:

changing in brightness;
changing in color;
blinking;
pulsing; and
flickering.

11. The resistance training device of claim 1, wherein the at least one two-part threaded axle comprises:

a first portion comprising a break end and a far end;
a second portion comprising a break end and a far end;
a break; and
an axle cover,
wherein the break end of the first portion and the break end of the second portion are adjacent to the break, and wherein the break end of the first portion and the break end of the second portion are encased within the axle cover.

12. The resistance training device of claim 11, wherein the first portion and second portion rotate independently of one another.

13. The resistance training device of claim 12, wherein the first portion and second portion rotate independently of the axle cover.

14. The resistance training device of claim 13, wherein the first portion is threaded into one of the four wheels, and wherein the second portion is threaded into another one of the four wheels.

15. The resistance training device of claim 14, wherein the main body comprises at least two holes, the at least two holes each comprising one bearing, wherein the first portion and the second portion of the at least one two-part threaded axle are each assembled to the resistance training device by concentrically mating with the bearing of one of the at least two holes.

16. The resistance training device of claim 1, further comprising one or more weight accepting features, wherein one or more weighted objects are added to the one or more weight accepting features by a user in order to increase the resistance of the resistance training device when in use.

* * * * *